United States Patent [19]

Tsubata

[11] Patent Number: 4,741,285

[45] Date of Patent: May 3, 1988

[54] APPARATUS FOR COATING ONE SIDE OF ONE OR MORE SURFACE TYPE FASTENER TAPES OR LIKE STRIPS

[75] Inventor: Noritaka Tsubata, Uozu, Japan

[73] Assignee: Yoshida Kogyo K. K., Tokyo, Japan

[21] Appl. No.: 937,993

[22] Filed: Dec. 5, 1986

[30] Foreign Application Priority Data

Dec. 17, 1985 [JP] Japan ..... 60-192962[U]

[51] Int. Cl.[4] ..... B05C 3/18

[52] U.S. Cl. ..... 118/415; 118/413

[58] Field of Search ..... 118/410, 415, 413; 427/356

[56] References Cited

U.S. PATENT DOCUMENTS 1,898,383 2/1933 Nash ..... 118/415 X 3,645,232 2/1972 Mishler ..... 118/415 X

*Primary Examiner*—John P. McIntosh

*Attorney, Agent, or Firm*—Hill, Van Santen, Steadman & Simpson

[57] ABSTRACT

An apparatus capable of simultaneously coating one side of each of several surface type fastener tapes or the like traveling longitudinally in coplanar, parallel spaced relation to one another. For simultaneously coating two fastener tapes a pair of terminal coating units and one intermediate coating unit are arranged alternately with the fastener tapes. Each fastener tape travels with its opposite longitudinal edge portions slidably engaged in recessed guideways defined in the terminal and intermediate coating units. A coating material is supplied through passageways in the coating units onto the surfaces of the fastener tapes traveling therebetween. Mounted to the coating units so as to extend across the fastener tapes, a doctor blade has its scraping edge held against the surfaces of the tapes. The fastener tape guideways in the coating units all decline from their upstream toward downstream ends with respect to the traveling direction of the tapes, so that the coating material collects in the spaces bounded by the tapes, coating units and doctor blade. The doctor blade creates a coating of constant thickness on each fastener tape as the latter travels therepast.

12 Claims, 6 Drawing Sheets

APPARATUS FOR COATING ONE SIDE OF ONE OR MORE SURFACE TYPE FASTENER TAPES OR LIKE STRIPS

BACKGROUND OF THE INVENTION

This invention relates to a coating apparatus, and more specifically to an apparatus for coating one side of one or more strips or tapes of any such materials as woven or nonwoven fabrics, plastics, paper, foam products, etc. The coating apparatus of this invention is of particular utility when used for applying a coating material of relatively high viscosity to the rear sides of elongate surface type fastener tapes having a multiplicity of hooks or loops on their front sides, in order to firmly anchor such hooks or loops to their carrier fabric.

The surface type fastener is known which comprises one fastener member having a multiplicity of hooks on a piece of carrier fabric, and another fastener member having a multiplicity of loops on another piece of carrier fabric. When pressed against each other, the two fastener members fasten together as a result of the interengagement of the hooks and loops. The hooks and loops are disengageable when the fastener members are forced apart. In the manufacture of such surface type fasteners, fastener tapes are prepared which are elongate strips of carrier fabric each having hooks or loops on its front side. The rear sides of these fastener tapes must be coated with a fluid material that, on curing, can provides a positive anchorage for the hooks or loops onto the carrier fabric against the possibility of detachment in use.

"Kiss roll coating" and "dip coating" represent two familiar methods of coating surface type fastener tapes or like strips. "Kiss roll coating" is such that the coating roller, partly immersed in a coating liquid in an open top vessel, carries a film of the liquid on its exposed upper portion. As the strip of substrate material travels in contact with the coating roller, part of the film transfers to the strip. In "dip coating", on the other hand, the strip to be coated is immersed in a vessel of coating material.

These conventional methods can both provide coatings of uniform thickness if the coating material is of relatively low viscosity. However, if the coating material is of higher viscosity, its layer on the desired strip tends to be of uneven thickness, particularly in cases where the strip to be coated is so pliant as to readily twist, bend or otherwise go out of planar shape while being coated.

The doctor blade has been a common expedient for applying high viscosity coating materials to surface type fastener tapes and other strips. For example, as taught by Japanese Laid Open Patent Application No. 59-228970, a strip or strips to be coated are fed in contact with a coating roller against which a doctor blade is held. The doctor blade is movable for adjustably varying the gap between itself and the coating roller, in order to form a metered film of the coating material on the roller. An objection to this prior art apparatus is that it has no provisions for guiding the strip as the same travels in contact wtih the coating roller. The strip is therefore easy to twist or bend while being coated, due in part to the minute variations in the diameter of the coating roller and to the oscillations of the revolving shaft on which it is mounted. The result has been irregularities in the thickness of the coating in the longitudinal direction of the strip.

The instant applicant is aware of a prior art device having means for positively guiding the strip being coated, as suggested by Japanese Laid Open Patent Application No. 59-80355. This known device, however, is applicable only for coating the longitudinal edge portions of the strip and is not adaptable for coating its complete surface.

SUMMARY OF THE INVENTION

The present invention provides an improved coating apparatus whereby a coating material, no matter how high its viscosity may be, can be continuously applied to one complete surface of a surface type fastener tape or like strip to an unvarying thickness, without the likelihood of the tape or strip twisting, bending or otherwise deforming while being coated. The coating apparatus of this invention is also notable for its ready adaptability for simultaneously coating two or any greater number of strips.

Briefly stated in its simplest form, the invention provides a coating apparatus for continuously coating one surface of an elongate strip of substrate material such as a surface type fastener tape traveling longitudinally along a predetermined path in a predetermined direction. The coating apparatus comprises at least a pair of coating units disposed opposite each other on both sides of the predetermined path of the strip. Each coating unit has a recessed guideway defined in its side surface directed toward the other coating unit, for slidably receiving one longitudinal edge portion of the strip, so that the strip has its opposite longitudinal edge portions slidably engaged in the guideways in the pair of coating units. Each coating unit has also defined therein a passageway for supplying a coating material onto the surface of the strip traveling between the pair of coating units. A doctor blade is mounted to the pair of coating units so as to extend across the predetermined path of the strip and having a scraping edge disposed opposite the surface of the strip so as to create a uniform film of the coating material thereon as the strip travels past the doctor blade.

The strip to be coated may be a surface type fastener tape which is very pliant before being coated. However, traveling through the coating apparatus of the foregoing construction, the tape is guided by having its opposite longitudinal edge portions slidably engaged in the recessed guideways in the pair of coating units. A coating of constant thickness can therefore be formed on one side of the tape as the same travels under the doctor blade after having the coating material supplied thereon.

Preferably, the recessed guideway in each coating unit has upper and lower guide surfaces extending along the path of the strip for relative sliding contact with the opposite surfaces of one longitudinal edge portion of the strip. The upper guide surface tapers in width from the upstream end toward the downstream end of the guideway with respect to the predetermined traveling direction of the strip, whereas the lower guide surface is of constant width throughout the length of the guideway. So constructed, the guideways can guide the strip still more positively and against the possibility of the meandering or oscillating of the strip as the same travels toward the doctor blade for stable contact therewith throughout the transverse dimension of the strip.

Another preferred feature of this invention resides in a guide ledge formed on each coating unit just under the recessed guideway substantially in parallel relation thereto and protruding toward the other coating unit. In coating a surface type fastener tape by the apparatus of this invention, the tape is fed through the apparatus with its rear side, having no loops or hooks formed thereon, directed upwardly in order to be coated as above stated. Thus, as the opposite marginal edge portions of the fastener tape are guided through the recessed guideways in their pair of coating units, the loops or hooks on its front side are guided by the guide ledges so as not to be ruined during the coating. Also, by so guiding the protuberant elements of the fastener tape, the gaps between the coating units and the fastener tape can be reduced to a minimum to prevent the leakage of the coating material therethrough.

According to an additional preferred feature of the invention, the recessed guideway in each coating unit declines from the upstream end toward the downstream end thereof with respect to the predetermined traveling direction of the strip. Traveling with its opposite longitudinal edge portions slidably engaged in the pair of guideways, the strip itself declines with the guideways. The doctor blade may be mounted upstandingly to the pair of coating units for relative sliding contact with the strip at the downstream ends of the pair of guideways, thereby making it possible to bend the strip into an obtuse angle to impart tension thereto. Consequently, supplied through the passageways in the coating units, the coating material will temporarily collect in the space bounded by the coating units, the doctor blade and the strip, and will form a film of constant thickness on the strip as the latter travels past the doctor blade.

Stated in another aspect thereof, the invention further provides an apparatus capable of simultaneously coating two or any desired greater number of surface type fastener tapes or other strips of substrate material traveling longitudinally in substantially coplanar, parallel spaced relation to one another. For simultaneously coating two strips, for example, there may be employed a pair of terminal coating units and one intermediate coating unit arranged alternately with the strips. The terminal coating units can be of exactly the same construction as the pair of coating units employed in the first described apparatus for coating one strip. The intermediate coating unit differs from each terminal coating unit in having a pair of recessed guideways defined in its opposite side surfaces. Each strip travels through the apparatus with its opposite longitudinal edge portions slidably engaged in one guideway in the intermediate coating unit and in the guideway in one terminal coating unit. A doctor blade is mounted to the terminal and intermediate coating units so as to extend across the strips.

It will therefore be apparent that the coating material can be applied to each strip just as previously set forth in connection with the first described apparatus. As will also be understood, any desired greater number of strips can be coated at one time merely by increasing the number of intermediate coating units. Two intermediate coating units may be employed for simultaneously coating three strips, three intermediate coating units for simultaneously coating four strips, and so forth.

The above and other features and advantages of this invention and the manner or realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

General

Figure 1:
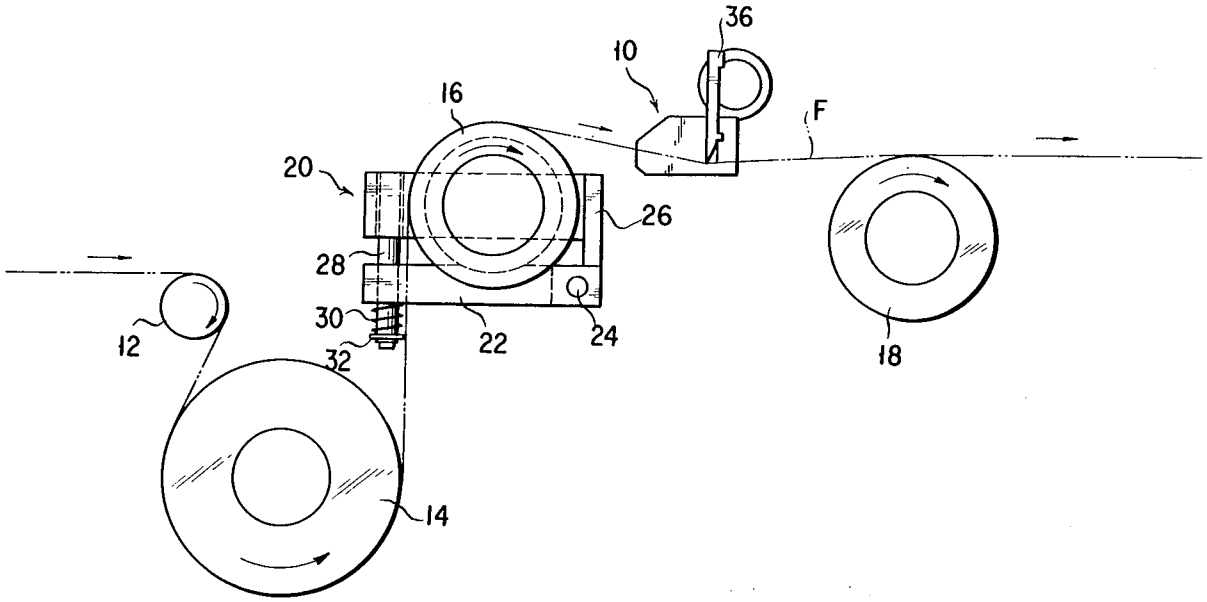
FIG. 1 is a diagrammatic elevation of a typical arrangement including the apparatus of this invention for coating one or more surface type fastener tapes.

The invention will now be described more specifically as adapted for simultaneously coating a plurality of surface type fastener tapes. As illustrated in FIG. 1, the fastener tapes F to be coated travel in the arrow marked direction along a predetermined path extending through the coating apparatus 10 of this invention. Hereinafter in this specification the directional terms "upstream" and "downstream" will be used in reference to this predetermined traveling direction of the fastener tapes F along the predetermined path.

The fastener tapes F are in coplanar, parallel spaced relation to each other as they travel along the predetermined path. Defining this path of the fastener tapes F are a smaller diameter guide roller 12, a larger diameter guide roller 14, an idler roller 16 and a drive roller 18. The guide rollers 12 and 14 and idler roller 16 are disposed on the upstream side of the coating apparatus 10 so as to provide a zigzag path for the fastener tapes. Disposed on the downstream side of the coating apparatus 10, the drive roller 18 makes driving engagement with the fastener tapes F for pulling the same through the coating apparatus.

The idler roller 16 is provided with a brake mechanism 20 comprising a brake arm 22 which is pivoted at one end on a pin 24 affixed to an inverted L shaped frame 26. Depending from the frame 26, a threaded guide rod 28 extends with clearance into and through a hole formed in the free end of the brake arm 22. A helical compression spring 30 is sleeved upon the guide rod 28 and acts between a nut 32 thereon and the brake arm 22 for biasing the latter into frictional engagement with the idler roller 16. The force of the compression spring 30 is adjustably variable to correspondingly regulate the frictional force exerted by the brake arm 22 on the idler roller 16 and, in consequence, the tension imparted to the fastener tapes F as the latter travel between idler roller 16 and drive roller 18.

Coating Apparatus

Figure 2:
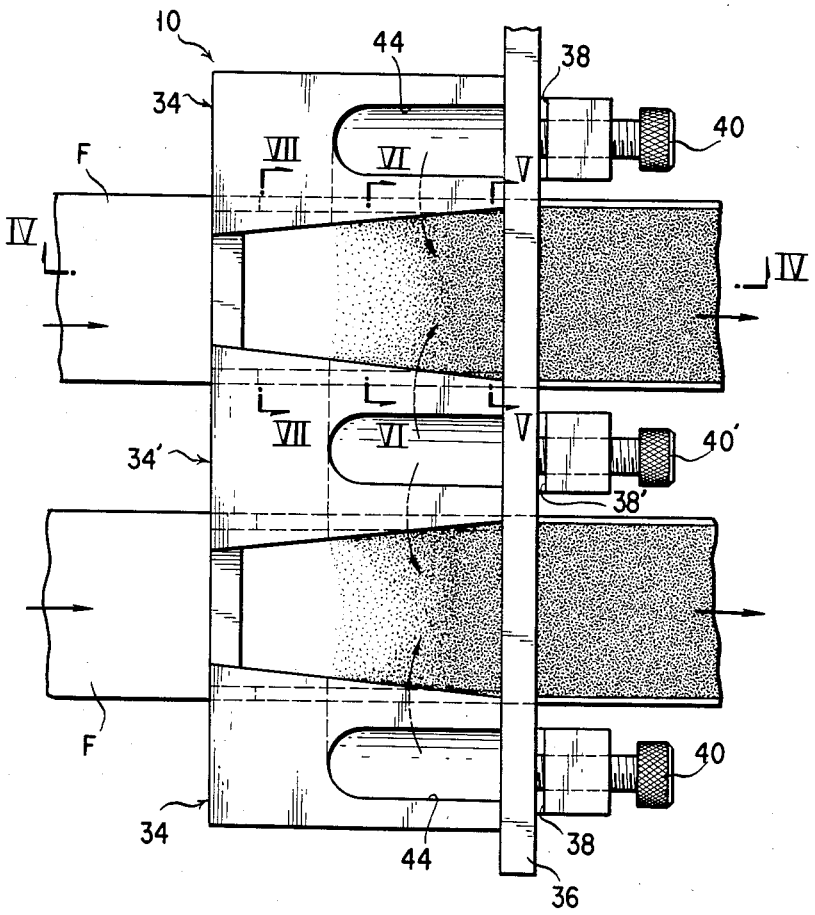
FIG. 2 is an enlarged top plan of the coating apparatus in the arrangement of FIG. 1, the coating apparatus being herein shown as adapted for simultaneously coating two surface type fastener tapes.

FIG. 2 is a detailed illustration of the coating apparatus 10, which is herein shown adapted for simultaneously coating two fastener tapes F. Broadly, the coating apparatus 10 comprises a pair of terminal coating units 34, an intermediate coating unit 34', and a doctor blade 36. The terminal coating units 34 are disposed on both sides of the fastener tapes F whereas the intermediate coating unit 34' is disposed between the fastener tapes.

The doctor blade 10 is mounted upstandingly to these terminal and intermediate coating units 34 and 34' so as to extend across the fastener tapes F. The coating units 34 and 34' have narrow openings 38 and 38', respectively, formed adjacent their downstream ends for receiving the doctor blade 36. Engaged in these openings 38 and 38', the doctor blade 36 is held fast by lock screws 40 and 40'. The lock screws 40 may be loosened for the adjustment, as required, of the relative positions of the terminal and intermediate coating units 34 and 34' to the widths of the fastener tapes F or other strips to be coated.

Terminal Coating Units

The pair of terminal coating units 34 are of substantially the same construction. Only one of these units 34 will therefore be described in detail with particular reference to FIG. 3, it being understood that the same description substantially applies to the other.

Figure 3:
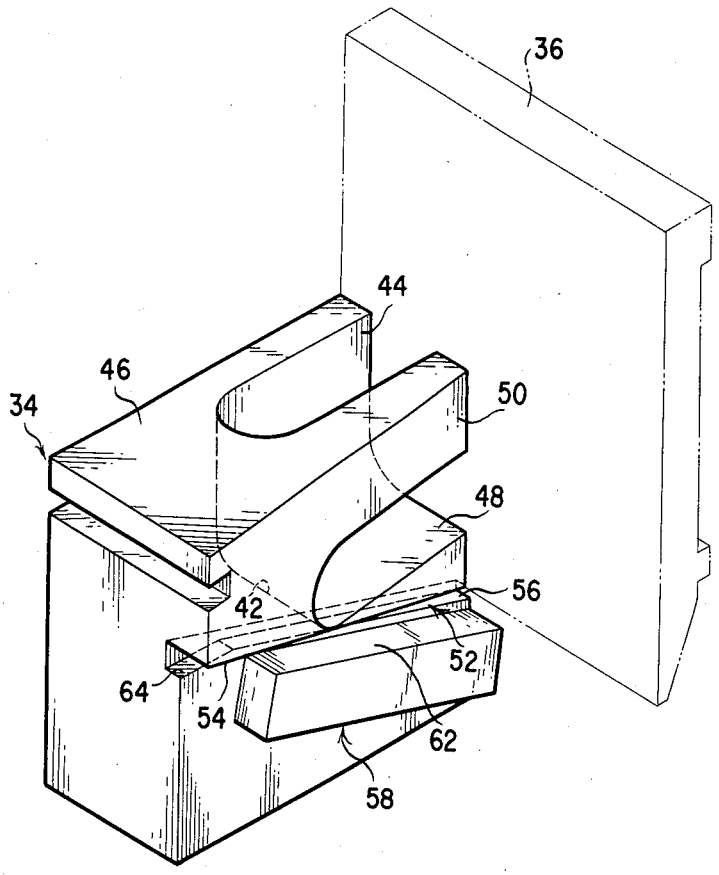
FIG. 3 is a perspective view of one of the pair of terminal coating units in the apparatus of FIG. 2, shown together with part of the doctor blade.

The representative terminal coating unit 34 of FIG. 3 is of approximately rectangular shape, having a passageway 42 defined therethrough for the supply of a desired coating material. The passageway 42 has an inflow end 44 in the top surface 46 of the terminal coating unit 34. Extending downwardly from this inflow end and bent right angularly, the passageway 42 leads to an outflow end 48 at the side surface 50 of the terminal coating unit 34 which is directed toward the intermediate coating unit 34'. The passageaway 42 is open to the doctor blade 36 mounted in the opening 38, FIG. 2, in the terminal coating unit 34.

Also formed in the side surface 50 of the terminal coating unit 34 and disposed under the outflow end 48 of the passageway 48 is a recessed guideway 52 extending along the path of one of the fastener tapes F being coated. As will be seen from FIG. 4, the guideway 52 is intended to slidably receive one longitudinal edge portion of one of the fastener tapes F being coated. Thus, in coaction with a similar guideway (to be set forth subsequently) in the intermediate coating unit 34', the guideway 52 serves to guide one fastener tape F through the coating apparatus 10.

Figure 5:
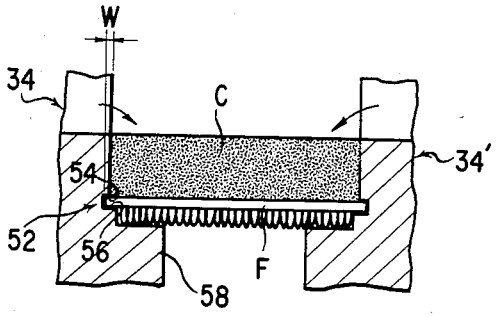
FIG. 5 is a vertical section through the coating apparatus of FIG. 2, taken along the line V—V therein and showing in particular one fastener tape traveling between one of the terminal coating unit and the intermediate coating unit.
Figure 6:
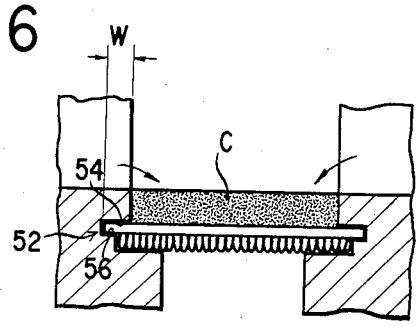
FIG. 6 is a view similar to FIG. 5 but taken along the line VI—VI in FIG. 2.
Figure 7:
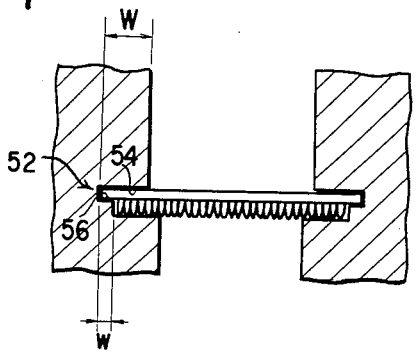
FIG. 7 is also a view similar to FIG. 5 but taken along the line VII—VII in FIG. 2.

As illustrated also in FIGS. 5, 6 and 7, which show both the representative terminating coating unit 34 and the intermediate coating unit 34', the recessed guideway 52 is defined by upper and lower guide surfaces 54 and 56 for relative sliding contact with the opposite surfaces of one longitudinal edge portion of the fastener tape F. The upper guide surface 54 tapers in width W (i.e. the dimension in the transverse direction of the fastener tape F) from the upstream end toward the downstream end of the guideway 52. The lower guide surface 56 can be of constant width w throughout the length of the guideway 52. it will be observed from FIGS. 5 through 7 that, gradually increasing in width W from the downstream end toward the upstream end of the guideway 52, the upper guide surface 54 protrudes toward the intermediate coating unit 34' in overhanging relation to the lower guide surface 56.

Seen at 58 in FIGS. 3 through 7 is a guide ledge formed on the side surface 50 of the coating unit 34 and disposed under the guideway 52 in parallel relation thereto. Each fastener tape F travels through the coating apparatus 10 with its rear side, which is to be coated, directed upwardly. On the downward facing front side of the fastener tape F there are formed a multiplicity of protuberant elements 60 herein shown as loops. The top surface 62 of the guide ledge 58, extending along the full length of the guideway 52, serves to guide the protuberant elements 60 of the fastener tape F.

It is to be understood that the illustrated coating apparatus 10 has the guide ledge 58 simply because it is herein shown adapted for coating the surface type fastener tapes having the protuberant elements 60. The guide ledge 58 is of course unnecessary in apparatus for coating other strips having no such protuberant elements.

Figure 4:
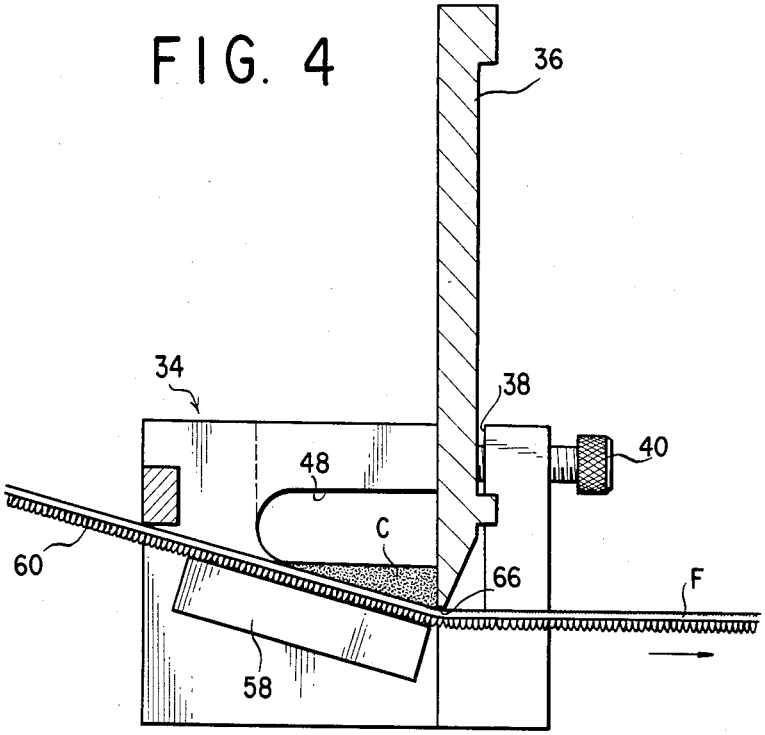
FIG. 4 is a vertical section through the coating apparatus of FIG. 2, taken along the line IV—IV therein and showing in particular one of the terminal coating units together with the doctor blade and one of the surface type fastener tapes being coated.

FIG. 4 best indicates that the guideway 52, as well as the guide ledge 58, declines from its upstream toward downstream end. As the guideway 52 in each terminal coating unit 34 and the associated guideway in the intermediate coating unit 34' are thus angled, so is the fastener tape F traveling with its opposite edge portions engaged in these guideways. The upstream end portion 64 of the lower guide surface 56 may be inclined downwardly as it extends toward the upstream end of the guideway 52 in order to expedite the insertion of the fastener tape F.

Figure 8:
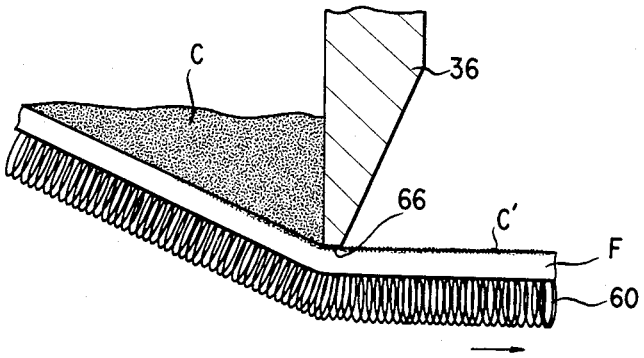
FIG. 8 is an enlargement of part of the showing of FIG. 4, the view being explanatory of the way in which the coating material is applied to each fastener tape by the apparatus of FIG. 2.

As shown also in FIG. 4 and on an enlarged scale in FIG. 8, the doctor blade 36 on being fully inserted in the opening 38 in the coating unit 34 has its scraping edge 66 held against the fastener tape F at the downstream end of the guideway 52, thereby bending the tape into an obtuse angle. The fastener tape F can thus be tensioned it extends from idler roller 16 to drive roller 18 in the arrangement of FIG. 1. The scraping edge 66 of the doctor blade 36 may be rounded so as to enable the fastener tape F to travel therepast under tension. The clearance between the fastener tape F and the scraping edge of the doctor blade 36 may be determined in consideration of such factors as the viscosity of the coating material C to be applied and the thickness of the coating on the fastener tape.

An inspection of FIGS. 4 and 8 will further reveal that, since the guideway 52 is inclined as aforesaid, and since the doctor blade 36 is held against the fastener tape F at the downstream end of the guideway, the coating material C on being supplied through the passageway 42 collects in the space bounded by the terminal and intermediate coating units 34 and 34' the doctor blade 36 and the fastener tape F. Thus, as the fastener tape F travels under the doctor blade 36, a uniform film C' of the coating material is formed on its rear side.

Intermediate Coating Unit

Figure 9:
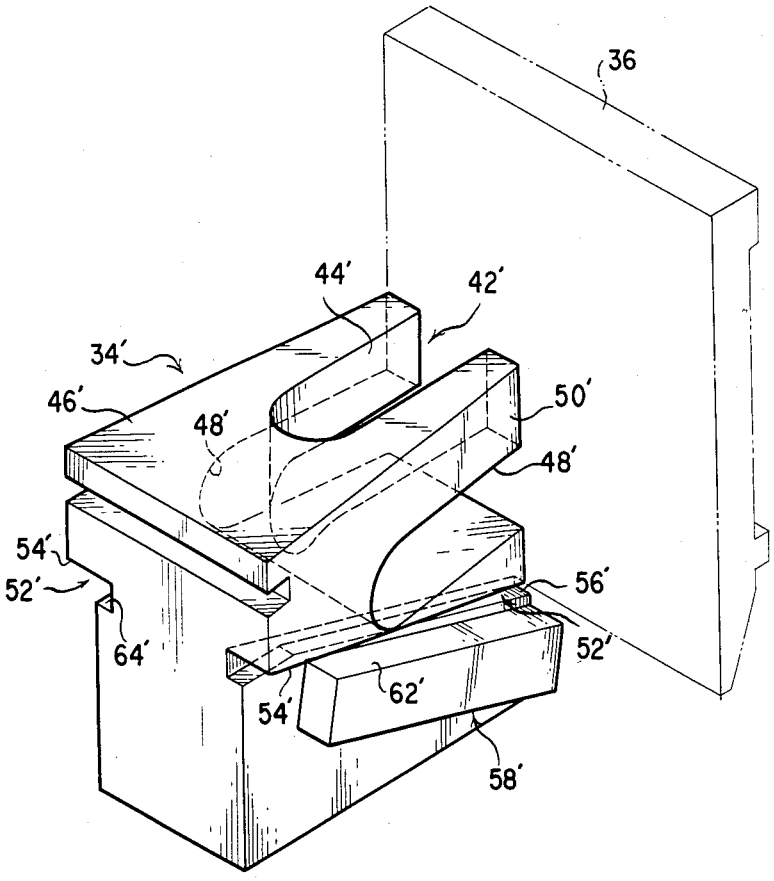
FIG. 9 is a perspective view of the intermediate coating unit in the apparatus of FIG. 2.

As illustrated in detail in FIG. 9, the intermediate coating unit 34' has a passageway 42' for supplying the coating material onto the two fastener tapes traveling on both sides thereof. Therefore, extending downwardly from an inflow end 44' in the top surface 46' of the coating unit 34', the passageway 42' is bifurcated at its bottom end into a pair of branch passageways leading respectively to a pair of outflow ends 48' formed in the opposite side surfaces 50', one seen, of the coating unit.

The intermediate coating unit 34' also differs from each terminal coating unit 34 in having a pair of recessed, sloping guideways 52' defined in its opposite side surfaces 50' and disposed under the outflow ends 48' of the passageway 42'. Each guideway 52' has an upper guide surface 54' of tapering width and a lower guide surface 56' of constant width. A pair of guide ledges 58', each having a sloping guide surface 62', are formed on both side surfaces of the coating unit 34' and are disposed under the guideways 52'. The other constructional details of the intermediate coating unit 34' are as previously set forth in connection with the pair of terminal coating units 34.

It is to be understood that the coating apparatus 10 of FIG. 2 has but one intermediate coating unit 34' because this apparatus is herein shown adapted for simultaneously coating two fastener tapes F. Two intermediate coating units of like construction may be provided, in combination with the pair of terminal coating units 34, for simultaneously coating three fastener tapes or like strips. Likewise, for coating a multiplicity of strips at one time, a multiplicity of intermediate coating units may be employed in combination with the pair of terminal coating units 34.

Operation

Driven by the drive roller 18 and retarded by the idler roller 16, the surface type fastener tapes F will travel in the predetermined direction through the coating apparatus 10 of this invention. In the coating apparatus 10 each fastener tape F has its opposite marginal edge portions slidably engaged in the guideway 52 in one terminal coating unit 34 and one of the guideways 52' in the intermediate coating unit 34'. Each fastener tape F will thus be stably guided toward the doctor blade 36, particularly as each guideway 52 or 52' has the upper guide surface 54 or 54' of tapering width and the lower guide surface 56 or 56' of constant width.

The protuberant elements 60 on the underside of the fastener tapes F are further guided by the guide ledges 58 and 58' on the coating units 34 and 34'. With the protuberant elements 60 so guided, the fastener tapes F will make closer contact with the upper guide surfaces 54 and 54' of the guideways 52 and 52', thereby minimizing the leakage of the coating material C.

Still further, as the guideways 52 and 52' as well as the guide ledges 58 and 58' decline from their upstream toward their downstream ends, the fastener tapes F can be tensioned by the doctor blade 36 having its rounded scraping edge 66 held against the fastener tapes at the downstream ends of the guideways. The clearance between the fastener tapes F and the doctor blade 36 is adjustable by the degree of tension exerted on the fastener tapes as they extend from idler roller 16 to drive roller 18.

While the fastener tapes F are so traveling through the coating apparatus 10, the coating material C may be fed into the passageways 42 and 42' in the coating units 34 and 34' through their inflow ends 44 and 44'. Flowing out of the outflow ends 48 and 48' of the passageways 42 and 42', the coating material will collect on the fastener tapes F just upstream of the doctor blade 36. As the fastener tapes F travel under tension past the doctor blade 36, the coating material C will be applied to their entire upper surfaces in the form of the films C' of constant thickness by virtue of the "wedge effect" of the coating material in the neighborhood of the scraping edge 66 of the doctor blade.

After having been so coated, the fastener tapes F will be fed further by the drive roller 18 toward the subsequent drying station, not shown, where the coatings will be dried.

It is to be understood that the coating apparatus disclosed in the foregoing is meant purely to illustrate or explain and not to impose limitations upon the invention. A variety of modifications or alterations will readily occur to one skilled in the art to conform to system requirements or design preferences, without departing from the scope of the invention.

What is claimed is:

1. An apparatus for continuously coating one side of an elongate strip of substrate material such as a surface type fastener tape traveling longitudinally along a predetermined path in a predetermined direction, the coating apparatus comprising:

(a) at least a pair of coating units disposed opposite each other on both sides of the predetermined path of the strip;

(b) there being a recessed guideway defined in that side surface of each coating unit which is directed toward the other coating unit, for slidably receiving one longitudinal edge portion of the strip, so that the strip has its opposite longitudinal edge portions slidably engaged in the guideways in the pair of coating units, said recessed guideway in each coating unit having upper and lower guide surfaces extending along said predetermined path of the strip for relative sliding contact with the opposite surfaces of one longitudinal edge portion of the strip, the upper guide surface tapering in width from an upstream end toward a downstream end of the guideway with respect to the predetermined traveling direction of the strip;

(c) there also being a passageway in each coating unit for supplying a coating material onto the surface of the strip traveling between the pair of coating units; and (d) a doctor blade mounted to the pair of coating units so as to extend across the predetermined path of the strip and having a scraping edge disposed opposite the surface of the strip so as to create a uniform film of the coating material thereon as the strip travels past the doctor blade.

2. The coating apparatus as recited in claim 1, wherein the lower guide surface of the recessed guideway in each coating unit is of approximately constant width throughout the length of the guideway.

3. The coating apparatus as recited in claim 1, wherein the doctor blade is mounted substantially upstandingly to the pair of coating units and is disposed adjacent the downstream ends thereof with respect to the predetermined traveling direction of the strip, and wherein the recessed guideway in each coating unit declines from an upstream end toward a downstream end thereof with respect to the predetermined traveling direction of the strip, whereby the coating material, supplied through the passageway in each coating unit, collects in the space bounded by the coating units and the doctor blade and the strip.

4. The coating apparatus as recited in claim 3, wherein the scraping edge of the doctor blade is rounded.

5. The coating apparatus as recited in claim 1, wherein the passageway for the coating material in each coating unit has an inflow end disposed in a top surface of the coating unit and an outflow end disposed in that side surface of the coating unit which is directed toward the other coating unit.

6. An apparatus for continuously and simultaneously coating one surface of each of a plurality of elongate strips of substrate material such as surface type fastener tapes traveling longitudinally along a predetermined path in a predetermined direction and in subtantially coplanar, parallel spaced relation to one another, the coating apparatus comprising:

(a) a pair of terminal coating units and at least one intermediate coating unit disposed alternately wtih the strips;

(b) each terminal coating unit having a recessed guideway defined in that side surface thereof which is directed toward the intermediate coating unit, for slidably receiving one longitudinal edge portion of one strip;

(c) the intermediate coating unit having a pair of recessed guideways defined in its opposite side surfaces, each for slidably receiving one longitudinal edge portion of one strip, so that each strip has its opposite longitudinal edge portions slidably engaged in one guideway in the intermediate coating unit and in the guideway in one terminal coating unit;

(d) the terminal and intermediate coating units also having passageways defined therein for supplying a coating material onto the surfaces of the strips traveling between the terminal and intermediate coating units; and (e) a doctor blade mounted to the terminal and intermediate coating units so as to extend across the predetermined path of the strips and having a scraping edge disposed opposite the surfaces of the strips so as to create a uniform film of the coating material thereon as the strips travel past the doctor blade.

7. The coating apparatus as recited in claim 6, wherein each recessed guideway in the terminal and intermediate coating units has upper and lower guide surfaces extending along the path of the strips for relative sliding contact with the opposite surfaces of one longitudinal edge portion of one strip, the upper guide surface tapering in width from an upstream end toward a downstream end of the guideway with respect to the predetermined traveling direction of the strips.

8. The coating apparatus as recited in claim 7, wherein the lower guide surface of each recessed guideway in the terminal and intermediate coating unit is of approximately constant width throughout the length of the guideway.

9. The coating apparatus as recited in claim 6, wherein the doctor blade is mounted substantially upstandingly to the terminal and intermediate coating units and is disposed adjacent the downstream ends thereof with respect to the predetermined traveling direction of the strip, and wherein the recessed guideways in the terminal and intermediate coating units decline from the upstream toward the downstream ends thereof with respect to the predetermined traveling direction of the strips, whereby the coating material, supplied through the passageways in the terminal and intermediate coating units, collects in the spaces bounded by the terminal and intermediate coating units and the doctor blade and the strips.

10. The coating apparatus as recited in claim 9, wherein the scraping edge of the doctor blade is rounded.

11. The coating apparatus as recited in claim 6, wherein each strip has a multiplicity of protuberant elements formed on its underside, wherein each terminal coating unit has a guide ledge disposed under the recessed guideway thereof and protruding therefrom toward the intermediate coating unit for relative sliding contact with the protuberant elements of one strip, and wherein the intermediate coating unit has a pair of guide ledges disposed under the respective recessed gudieways thereof and protruding therefrom toward the terminal coating units for relative sliding contact with the protuberant elements of the strips.

12. The coating apparatus as recited in claim 6, wherein the passaegway for the coating material in each terminal coating unit has an inflow end disposed in a top surface of the terminal coating unit and an outflow end disposed in that side surface of the terminal coating unit which is directed toward the intermediate coating unit, and wherein the passageway for the coating material in the intermediate coating unit has an inflow end disposed in a top surface of the intermediate coating unit and a pair of outflow ends disposed in the opposite side surfaces of the intermediate coating unit which are directed toward the respective terminal coating units.

* * * * *